US007726037B1

(12) United States Patent
Jordan

(10) Patent No.: US 7,726,037 B1
(45) Date of Patent: Jun. 1, 2010

(54) FENCE POST CENTERING ASSEMBLY AND METHOD

(76) Inventor: Christopher A. Jordan, 9726 Wilkie St., Taylor, MI (US) 48180

( * ) Notice: Subject to any disclaimer, the term of this patent is extended or adjusted under 35 U.S.C. 154(b) by 96 days.

(21) Appl. No.: 12/129,307

(22) Filed: May 29, 2008

(51) Int. Cl.
*G01B 3/30* (2006.01)

(52) U.S. Cl. ..... 33/613

(58) Field of Classification Search ..... 33/613, 33/1 G, 666, 413, 414, 644, 645, 669
See application file for complete search history.

(56) References Cited

U.S. PATENT DOCUMENTS

| | | | | | |
|---|---|---|---|---|---|
| 1,564,721 | A | * | 12/1925 | Tallon | 111/99 |
| 3,197,874 | A | * | 8/1965 | Fox | 33/194 |
| 3,201,874 | A | | 8/1965 | Christy | |
| 4,527,337 | A | | 7/1985 | Dreiling | |
| 4,625,415 | A | * | 12/1986 | Diamontis | 33/613 |
| 4,889,322 | A | * | 12/1989 | Wagner | 256/36 |
| 5,042,159 | A | * | 8/1991 | Millen | 33/414 |
| 5,129,153 | A | * | 7/1992 | Burns, Sr. | 33/613 |
| 5,628,119 | A | | 5/1997 | Bingham et al. | |
| 5,937,531 | A | * | 8/1999 | Menk et al. | 33/613 |
| 6,658,753 | B2 | | 12/2003 | Tatarnic | |
| 7,377,489 | B1 | * | 5/2008 | Houseman | 256/22 |
| 2002/0170189 | A1 | * | 11/2002 | Cheatham | 33/194 |
| 2006/0010703 | A1 | * | 1/2006 | Gauthier | 33/613 |
| 2009/0119941 | A1 | * | 5/2009 | Sentz | 33/755 |

* cited by examiner

*Primary Examiner*—Christopher W Fulton

(57) ABSTRACT

A fence post centering assembly and method includes an elongated member that has a first end and a second end. A first head member and second head member are provided. Each of the first and second ends is removably engaged with one of the first and second head members. Each of the first and second head members includes a receiving slot. A first post is positionable in the receiving slot of the first head member and a second post is positioned in the receiving slot of the second head member to ensure a proper positioned between the first and second posts.

2 Claims, 4 Drawing Sheets

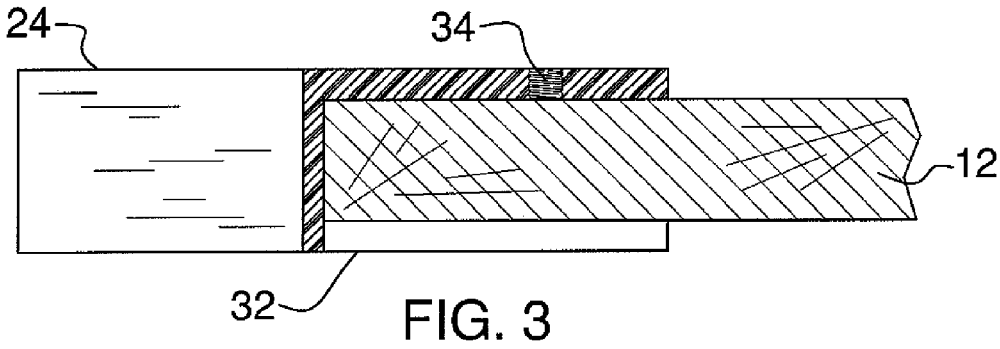
FIG. 3
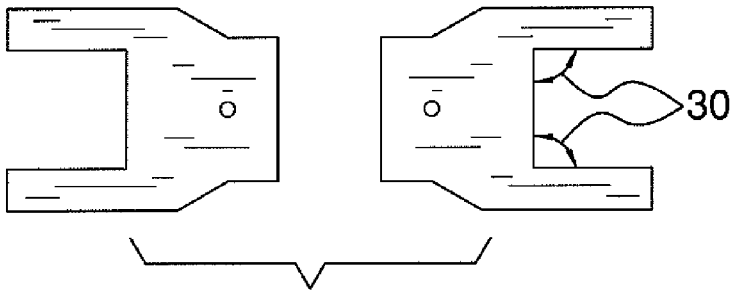
FIG. 4
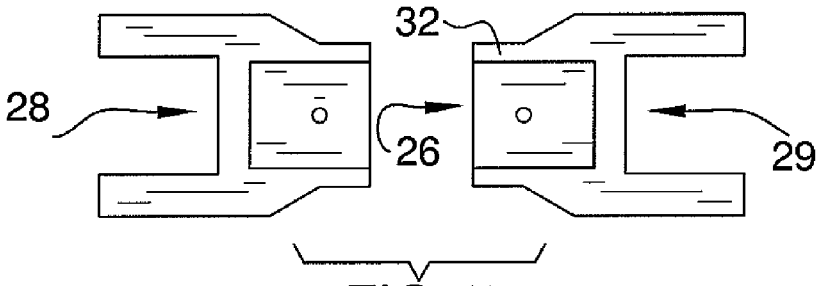
FIG. 5
FIG. 6
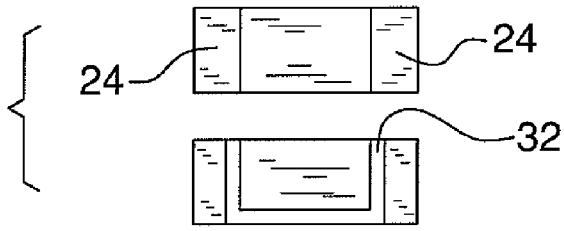

FENCE POST CENTERING ASSEMBLY AND METHOD

BACKGROUND OF THE INVENTION

1. Field of the Invention

The present invention relates to fence post centering devices and more particularly pertains to a new fence post centering device for assisting a person in determining the location of where to position fence posts so that the fence posts are equally spaced from each other.

2. Summary of the Invention

The present invention meets the needs presented above by generally comprising an elongated member that has a first end and a second end. A first head member and second head member are provided. Each of the first and second ends is removably engaged with one of the first and second head members. Each of the first and second head members includes a receiving slot. wherein a first post is positionable in said receiving slot of said first head member, and wherein a second post is positioned in said receiving slot of said second head member to ensure a proper positioning between said first and second posts.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross-sectional view taken along line 3-3 of FIG. 1 of the present invention.

FIG. 4 is a top view of heads of the present invention.

FIG. 5 is a bottom view of heads of the present invention.

FIG. 6 is a front and a rear view of the heads of the present invention.

DESCRIPTION OF THE PREFERRED EMBODIMENT

Figure 1:
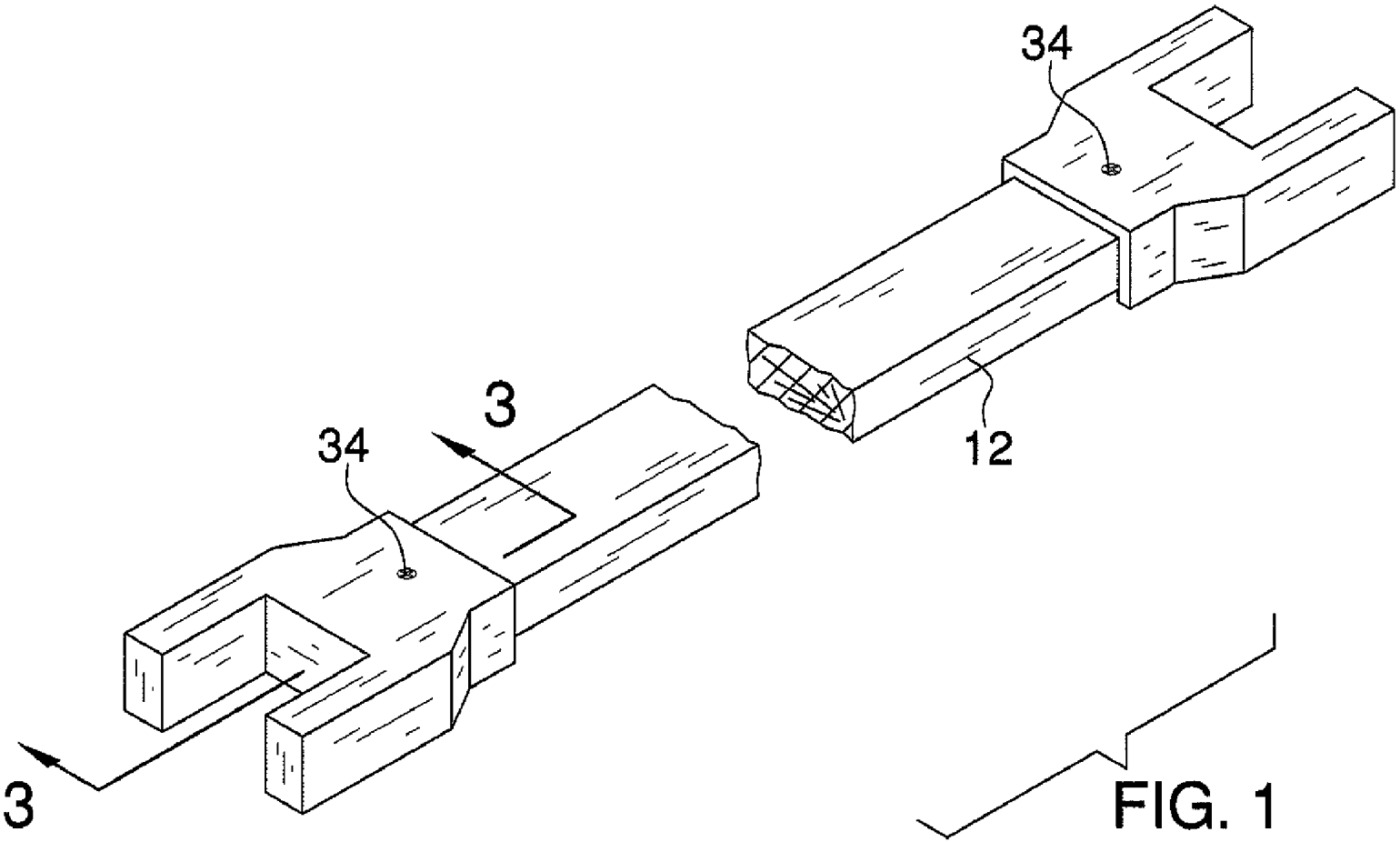
FIG. 1 is a broken top perspective view of a fence post centering assembly according to the method of the present invention.
Figure 2:
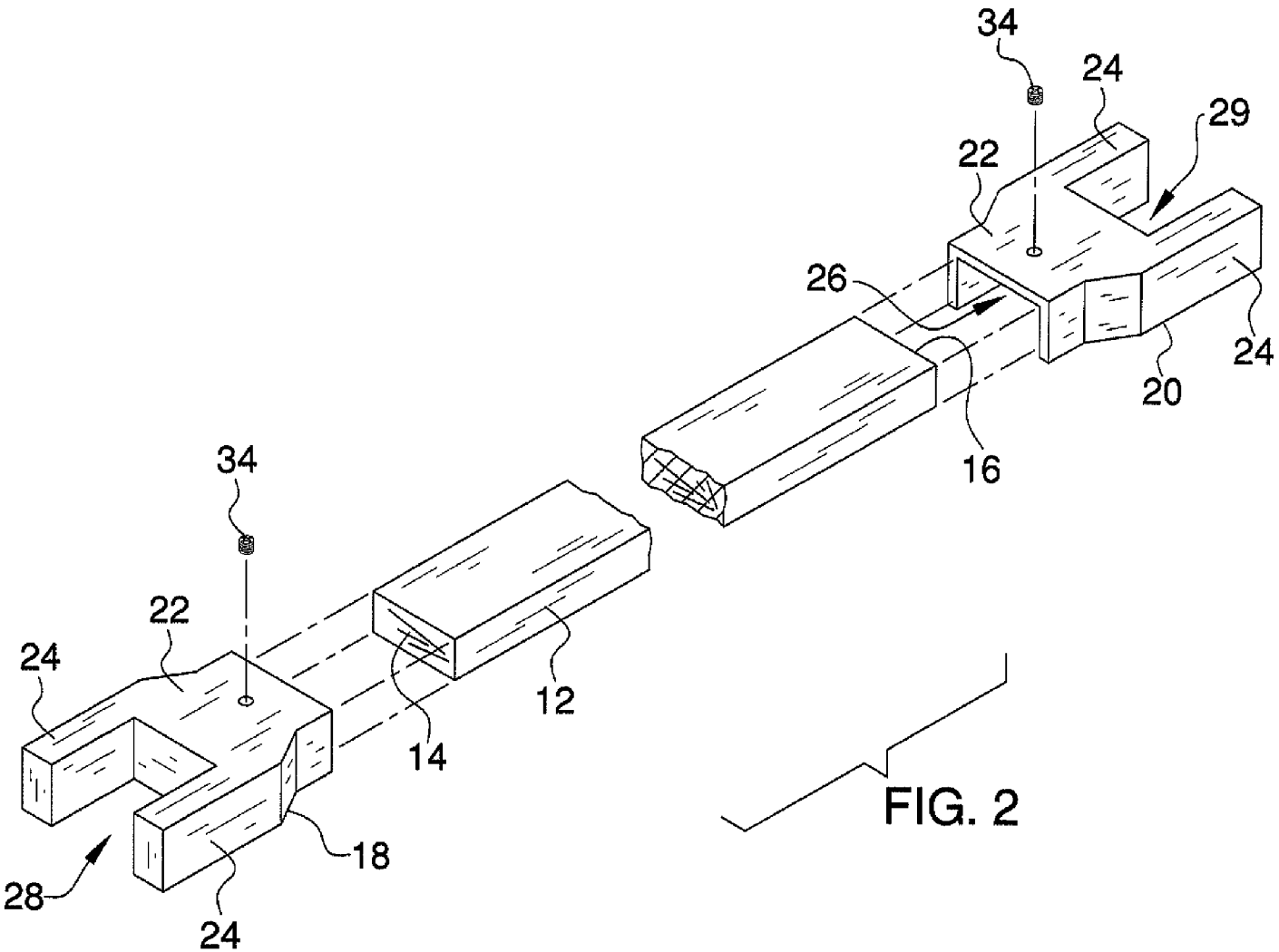
FIG. 2 is a broken top expanded view of FIG. 1 of the present invention.
Figure 7:
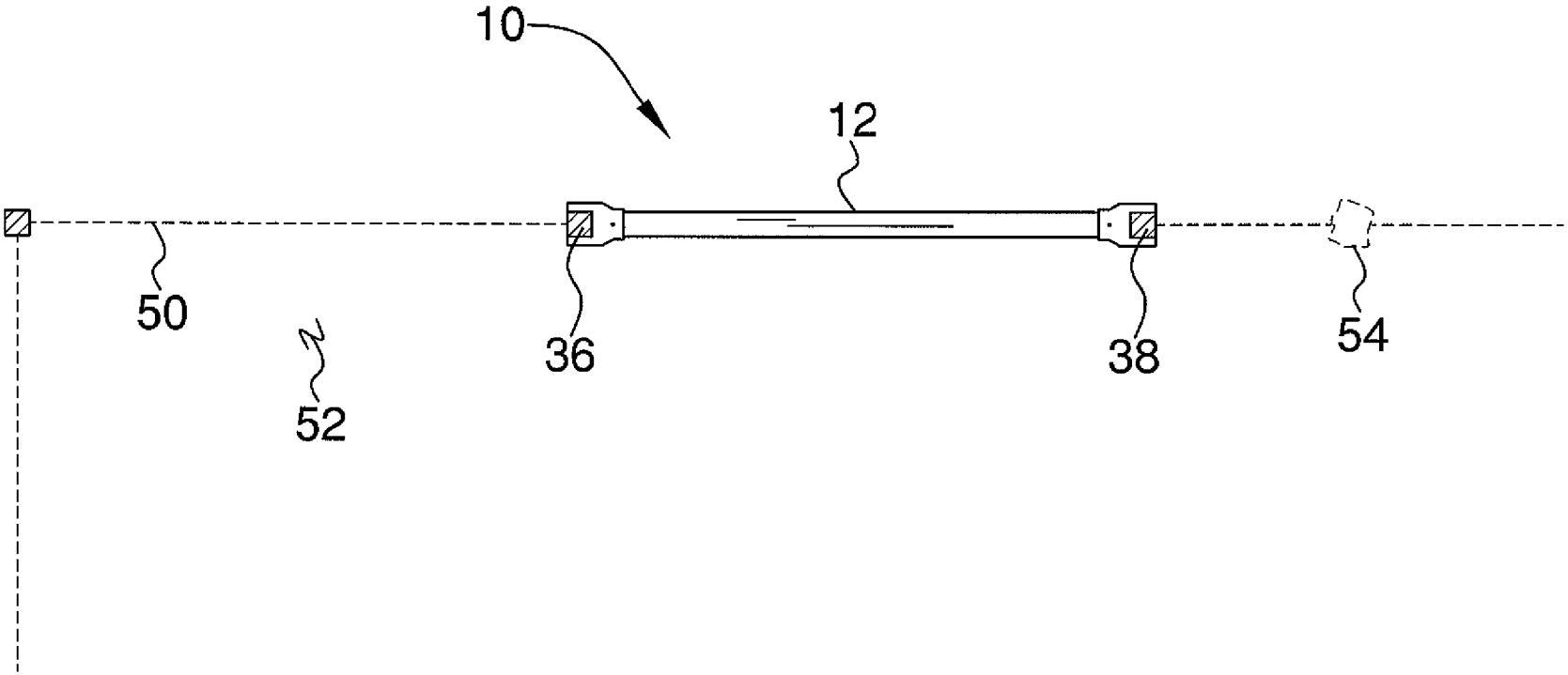
FIG. 7 is a top in-use view of the present invention.

With reference now to the drawings, and in particular to FIGS. 1 through 7 thereof, a new fence post centering device embodying the principles and concepts of the present invention and generally designated by the reference numeral 10 will be described.

As best illustrated in FIGS. 1 through 7, the fence post centering assembly 10 and method generally includes providing an elongated member 12 that has a first end 14 and a second end 16. The elongated member 12 may have any selectable length and would generally be equal to the length of the fence sections to be mounted between fence posts.

A first head member 18 and second head member 20 are provided. Each of the first 18 and second 20 head members includes a sleeve 22 and a pair of arms 24 attached to the sleeve 22 opposite an opening 26 extending into the sleeve 22. The arms 24 of an associated one of the head members 18, 20 extend in a same direction with respect to each other and in an opposite direction of the opening 26. The arms 24 are spaced from each other and a receiving slot having a pair of perpendicular angles 30 is defined between the arms 24. The first head member 18 includes a first receiving slot 28 and the second head member includes a second receiving slot 29. Each of the first 14 and second 16 ends is extended into one of the sleeves 22. This allows the elongated member 12 to be changed as needed to vary a length between the first 18 and second 20 head members. Each of the arms 24 of the first head member 18 is axially aligned with one of the arms 24 of the second head member 20. The sleeves 22 may be open on bottom sides 32 thereof to allow for different heights of the elongated member 12.

At least two fasteners 34 are provided. Each of the first 18 and second 20 head members may be secured to the elongated member 12 with the fasteners 34. In particular, the fasteners 34 extend into the sleeves 22 of the first 18 and second 20 head members. This will prevent the head members 18, 20 from sliding off of the elongated member 12 during the usage of the assembly 10.

In use, a chalk line 50 is placed on a ground surface 52 along a line where a fence with be positioned. The elongated member 12 is then placed along the chalk line 50 and positions are marked on the ground surface 52, such as with spray paint, where each of the receiving slots 28, 29 is positioned. The first receiving slot 28 is then moved to a position where the second receiving spot 29 was located and a new position of the second receiving slot 29 is marked on the ground surface 52. The above steps of marking the ground surface 52 is repeated until a position for each needed hole 54 for a fence post 36, 38 is marked along the chalk line. A hole 54 is then dug where each position was marked to define a plurality of holes 54 located along the chalk line 50.

Fence posts 36, 38 are then placed in each of the holes 54 and a support material is placed in two adjacently positioned one of the holes to support the fence posts 36, 38 therein. The support material may be any material used to support a fence post but may include a cement material. One 36 of a pair of adjacent ones of the fence posts is positioned into the receiving slot 28 of the first head member 18 and another one 38 of the pair of fence posts is positioned in the receiving slot 29 of the second head member 20. The fence posts 36, 38 are positioned in the receiving slots are vertically oriented and pressed into an associated one of the receiving slots 28, 29 to ensure that they are a proper distance from each other. The steps of placing support material into adjacent holes 54 and vertically aligning the posts 36, 38 therein while pressing them into an associated one of the receiving slots 28, 29 is repeated until each of the holes 54 is filled with a properly supported fence post.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of centering a fence post centering method, said method comprising the steps of:

providing an elongated member having a first end and a second end;

providing a first head member and second head member, each of said first and second head members including a sleeve and a pair of arms being attached to said sleeve opposite an opening extending into said sleeve, said arms of an associated one of said head members extending in a same direction with respect to each other in an opposite direction of said opening, said arms being spaced from each other, a receiving slot being defined between said arms and defining first and second receiving slots of said first and second head members;

placing a chalk line on a ground surface along a line to position a fence;

placing said elongated member along said chalk line;

marking a position of each of said first and second receiving slots on said ground surface;

moving said first receiving slot to a position where said second receiving spot is located and marking a new position of said second receiving slot on said ground surface;

repeating the step of moving said first receiving slot to the position where said receiving spot is located and marking the new position of said second receiving slot until a position for each needed hole for a fence post is marked along said chalk line digging a hole where each position was marked to define a plurality of holes located along said chalk line;

positioning a fence posts in said holes;

placing a support material in two adjacently positioned one of said holes to support said fence posts therein;

positioning one of a pair of adjacent ones of said fence posts into said receiving slot of said first head member and another one of the pair of fence posts in said receiving slot of said second head member;

vertically orienting each of said first and second posts while pressing said first and second posts into an associated one of said receiving slots; and repeating the steps of placing support material into adjacent holes while pressing said posts therein into an associated one of said receiving slots until each of said holes has supported ones of said posts.

2. A method of centering a fence post method, said method comprising the steps of:

providing an elongated member having a first end and a second end;

providing a first head member and second head member, each of said first and second head members including a sleeve and a pair of arms being attached to said sleeve opposite an opening extending into said sleeve, said arms of an associated one of said head members extending in a same direction with respect to each other in an opposite direction of said opening, said arms being spaced from each other, a receiving slot being defined between said arms and defining first and second receiving slots corresponding with said first and second head members;

extending each of said first and second ends into one of said sleeves, each of said arms of said first head member being axially aligned with one of said arms of said second head member;

providing at least two fasteners;

securing each of said first and second head members to said elongated member with said fasteners;

placing a chalk line on a ground surface along a line to position a fence;

placing said elongated member along said chalk line;

marking a position of each of said first and second receiving slots on said ground surface;

moving said first receiving slot to a position where said second receiving spot is located and marking a new position of said second receiving slot on said ground surface;

repeating the step of moving said first receiving slot to the position where said receiving spot is located and marking the new position of said second receiving slot until a position for each needed hole for a fence post is marked along said chalk line digging a hole where each position was marked to define a plurality of holes located along said chalk line;

positioning a fence posts in said holes;

placing a support material in two adjacently positioned one of said holes to support said fence posts therein;

positioning one of a pair of adjacent ones of said fence posts into said receiving slot of said first head member and another one of the pair of fence posts in said receiving slot of said second head member;

vertically orienting each of said first and second posts while pressing said first and second posts into an associated one of said receiving slots; and repeating the steps of placing support material into adjacent holes while pressing said posts therein into an associated one of said receiving slots until each of said holes has supported ones of said posts.

* * * * *